US007726074B2

(12) United States Patent
Kollner et al.

(10) Patent No.: US 7,726,074 B2
(45) Date of Patent: Jun. 1, 2010

(54) WINDOW-WINDING ARRANGEMENT

(75) Inventors: Harald Kollner, Altenstadt (DE); Enrico Schliwa, Lauchröden (DE); Bernhard Sielhorst, Sontra (DE); Bernhard Eckhardt, Wetzlar (DE)

(73) Assignee: Faurecia Innenraum Systeme GmbH, Hagenbach (DE)

( * ) Notice: Subject to any disclaimer, the term of this patent is extended or adjusted under 35 U.S.C. 154(b) by 844 days.

(21) Appl. No.: 10/536,582

(22) PCT Filed: Nov. 25, 2003

(86) PCT No.: PCT/EP03/13252

§ 371 (c)(1),
(2), (4) Date: Nov. 15, 2005

(87) PCT Pub. No.: WO2004/048732

PCT Pub. Date: Jun. 10, 2004

(65) Prior Publication Data

US 2006/0185248 A1 Aug. 24, 2006

(30) Foreign Application Priority Data

Nov. 25, 2002 (DE) ..... 102 55 461

(51) Int. Cl.
*E05F 11/48* (2006.01)

(52) U.S. Cl. ..... 49/352; 49/349; 49/348

(58) Field of Classification Search ..... 49/348, 49/349, 352, 374, 502
See application file for complete search history.

(56) References Cited

U.S. PATENT DOCUMENTS 1,602,997 A * 10/1926 Beckwith ..... 49/120
1,659,587 A * 2/1928 Bacso ..... 49/352
2,491,138 A * 12/1949 Scinta ..... 24/132 R
4,970,827 A * 11/1990 Djordjevic ..... 49/349

(Continued)

FOREIGN PATENT DOCUMENTS

DE 690 27 127 T2 4/1990

(Continued)

OTHER PUBLICATIONS

International Search Report for PCT/EP2003/13252, date of completion Mar. 26, 2004.

*Primary Examiner*—Katherine W Mitchell
*Assistant Examiner*—Catherine A Kelly
(74) *Attorney, Agent, or Firm*—Mark J. Nahnsen; Barnes & Thornburg LLP

(57) ABSTRACT

The present invention relates to a window-winding arrangement (1) as well as a motor vehicle door containing this window-winding arrangement. The window-winding arrangement contains a drive means (5) as well as a guide means for the drive and for guiding a pane (2) belonging to the window-winding arrangement. The drive means and guide means is designed in a manner such that the drive force for movement is applied onto the pane such that this (4.1; 4.2) independently of its movement direction is always pressed against a certain guide edge (6*c*) of the guide means. With this it is rendered possible on manufacture of the window-winding arrangement to envisage greater tolerances as well as to do away with the costintensive installation of additional guide rails in the door inner space. Furthermore one achieves a reduction in friction as well as a reduction in weight.

13 Claims, 5 Drawing Sheets

U.S. PATENT DOCUMENTS

Figure 1:
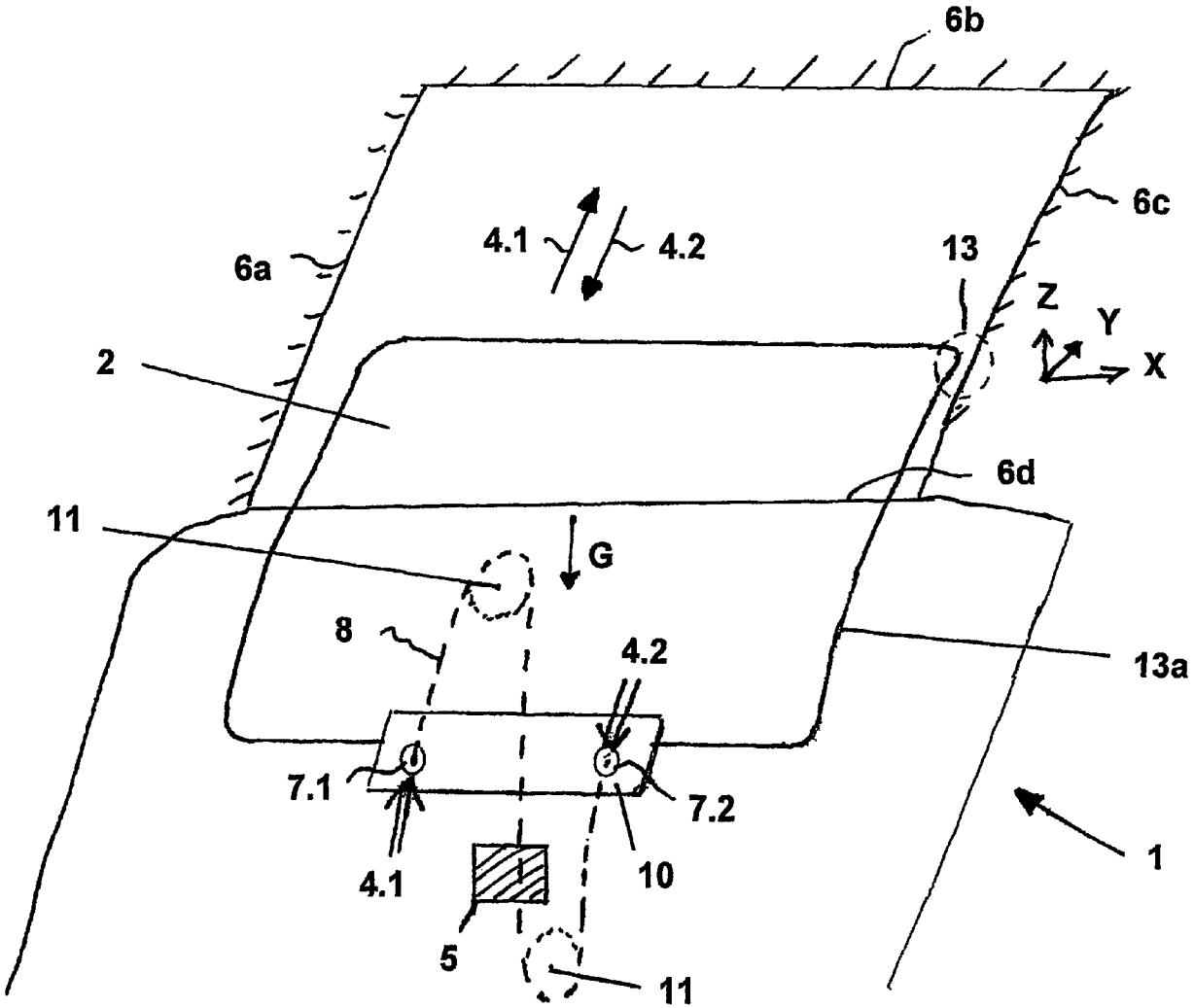

| | | | | |
|---|---|---|---|---|
| 5,469,668 | A * | 11/1995 | Heim et al. | 49/502 |
| 5,490,354 | A * | 2/1996 | Klippert | 49/352 |
| 5,613,322 | A * | 3/1997 | Kobrehel | 49/352 |
| 5,950,365 | A * | 9/1999 | Lieb et al. | 49/28 |
| 5,964,063 | A * | 10/1999 | Hisano et al. | 49/502 |
| 6,430,873 | B1 * | 8/2002 | Borchuk et al. | 49/352 |
| 6,840,012 | B2 * | 1/2005 | Dufour et al. | 49/352 |
| 2002/0066232 | A1 * | 6/2002 | Tatsumi et al. | 49/502 |
| 2002/0083647 | A1 * | 7/2002 | Bostian et al. | 49/352 |
| 2003/0029092 | A1 * | 2/2003 | Bertolini et al. | 49/352 |
| 2003/0097795 | A1 * | 5/2003 | Dufour et al. | 49/352 |
| 2003/0106267 | A1 * | 6/2003 | Dron | 49/352 |
| 2004/0049986 | A1 * | 3/2004 | Barr et al. | 49/352 |
| 2004/0154227 | A1 * | 8/2004 | Yoshimura | 49/352 |
| 2004/0163320 | A1 * | 8/2004 | Kirejczyk | 49/352 |
| 2005/0011130 | A1 * | 1/2005 | Klippert et al. | 49/352 |

FOREIGN PATENT DOCUMENTS

| | | | |
|---|---|---|---|
| DE | 295 03 036.4 | U1 | 2/1995 |
| DE | 195 09 205 | A1 | 3/1995 |
| DE | 296 13 322 | U1 | 8/1996 |
| DE | 696 06 263 | T2 | 11/1996 |
| DE | 199 42 643 | A1 | 3/2001 |
| FR | 2 831 588 | | 5/2003 |
| GB | 2 230 558 | A | 10/1990 |

* cited by examiner

WINDOW-WINDING ARRANGEMENT

RELATED APPLICATIONS

This Application is a U.S. Nationalization of PCT Application No. PCT/EP2003/13252, filed Nov. 25, 2003, which claims priority to German application DE 102 55 461.7 filed on Nov. 25, 2002. The prior applications are expressly incorporated herein by reference in their entirety.

The invention relates to a window-winding arrangement as well as a vehicle door which contains such a window-winding arrangement.

There are known window-winding arrangements for side windows of motor vehicles. Such known window-winding arrangements according to the state of the art have a drive as well as guide means for driving and guiding a pane belonging to the window-winding arrangement. This is not the case with scissor window-winders. Here the window-winder does not assume any guiding of the glass.

With this the drive means is for example realised as a pull cable mechanism which guides the side pane (the term "side pane" is to encompass a component, irrespective of the material (glass, plastic . . . ), which is completely, partly or not at all transparent (manually or electrically actuated) within rails which are accommodated in the A, B or C columns. The guiding of the glass with classic pull cable window-winders is ensured by the "pane" guides in the door columns and by the window-winders (path control by one or more guide rails). The drive means is usually located in the door e.g. below the window and is designed with one or two rails. A lug with the drive chain runs on rails. The window is then led through the rails and the glass guide. The drive may however also be accommodated in the A, B or C-columns (this however is seldom the case).

Such window-winding arrangements according to the state of the art have the problem that complicated devices are provided which are to achieve an absolutely unambiguous guiding of the pane. This may be effected for example in that in the inside of the door that is to say below the window opening which is closed by the pane there are attached additional guide rails into which the pane engages with a non-positive and/or positive fit. With this however there is the problem that these additional guide means are very intensive in their weight and furthermore demand a large construction space. Furthermore the guiding of the glass is overdefined, i.e. a costly matching of all components which are part of the tolerance chain is required in order on the one hand to prevent a jamming and on the other hand to prevent too great a freedom in "X".

If however no additional guide means were provided then a jamming of the pane in the guide rails (e.g. with single track systems) would often occur so that under certain circumstances the motor vehicle pane may not be move any more at all. It previously led to a significant increase in the torque which needs to be confronted with an increased technical expense (e.g. gears).

It is therefore the object of the present invention to create a window-winding arrangement which on the one hand securely prevents the jamming of the pane on winding up and winding down and furthermore saves space and weight.

A window-winding arrangement or a motor vehicle door according to the independent claims achieves this object.

By way of the fact that with a window-winding arrangement of the known type the drive and guide means are designed in a manner such that the drive force for movement is applied onto the pane such that this is always pressed against a certain guide edge of the guide means independently of its movement direction, this object is accomplished with respect to the window-winding arrangement.

The invention thus follows a completely different idea than previous common window-winding arrangements. Until now it was attempted with window-winding arrangements to always achieve an absolutely constant guiding independently of the movement direction (thus on winding and lowering the pane). This was attempted by the guiding being effected uniformly for example by way of the above mentioned rails or by other measures, for example by always engaging the pane below its centre of gravity. With conventional panes it was thus usual for a "rocking" of the pane to arise on winding up or winding down with a bearing on different guide edges according to the desired movement direction (with single-track pull cable systems).

The invention consciously moves away from this concept. The drive and guide means is designed in a manner such that the drive force for moving the pane is introduced onto this such that this is always pressed against a certain (that is to say merely a single, for each movement direction, constant) guide edge of the guide means independently of its movement direction (thus on winding up or winding down the pane). The subject-matter of the application differs from the state of the art in particular by the fact that the drive force independently of its movement direction is always pressed against a defined guide edge of the guide means which is exactly fixed during the design phase of the window-winding arrangement. One thus attempted additionally to the movement direction (thus the "main movement direction") of the pane, to additionally rotate this such that this is always pressed against a completely defined guide edge. As an ideal condition one strives for a complete bearing of the pane edge concerned parallel to the guide edge, in that for example a pull cable vector direction is suitably set, perhaps via adjustment of deflection elements such as rollers, etc. One thus strives for the pane to be applied translatorily and/or rotated such that as good as possible bearing of the pane edge concerned on the desired guide edge is given. For this, a mechanism must be provided which on lifting as well as lowering the pane permits an alignment in a very defined spatial direction. Various constraints must be observed with the design of the window-winding device according to the invention. Thus one must observe the friction forces of the system (in particular those directly on the pane), here in particular the friction forces in the possible guide rails (in FIG. 1 indicated at reference numerals 6*a* and 6*c*). At the same time remaining sealing lips etc. are to be taken into account (components which are indicated in FIG. 1 with reference numerals 6*b* or 6*d*). A reduction in the friction is to be particularly noticed in that no contact exists between a lug and a separate window guide rail below the window. In cold seasons (low temperatures) this contact often leads to double the displacing forces (200%) of the pane. According to the invention only a 10% increase due to the remaining contact between the window and the window guide may be ascertained. Apart from these friction forces of course also the inertia forces are essential with regard to the invention, furthermore a suitable arrangement for the rollers is to be observed in order thus to achieve a desired vector direction of the resulting forces onto the pane.

In contrast to such a targeted matching it would be usual for a rotation of the pane in various direction to take place on lifting and lowering. By way of this however the above-described jamming is rendered possible again which could lead to a "rocking" or even to a jamming of the panes.

The invention thus permits the provision of a window-winding arrangement which requires less force on winding up or winding down the pane (see that which has been cited on friction reduction). By way of this for example with an electrical drive one may provide a smaller motor (load reduction in winter up to 20%) which leads to a weight reduction of 170 g, Bosch Motor FPC2 of Bosch-FPG) with the electrical systems.

It is further possible to provide greater manufacturing tolerances for the window-winding arrangement. An additional guide rail which however is possibly provided in the door inner space does not need to lie below the centre of gravity, it may be constructed at any location according to where space is. This reduces the number of components in the tolerance chain of approx. 11 (depending on the construction of the door) to 4.

Basically the invention may be applied to all guided pane-like elements. This may for example be the side pane in front and rear doors of vehicles for persons or lorries. Of course this may also be the rear window of such vehicles. Furthermore other vertically or horizontally arranged movable plates might be provided with the winding arrangement according to the invention.

Advantageous further formations of the present invention are described in the dependent claims.

A particularly advantageous further development envisages for the characterising feature of the invention to be realised in that a first and a second force engagement point are provided for the drive means on the pane, wherein with the drive of the drive means in one direction the first force engagement point is loaded more, and with the drive in a second direction opposite to the first direction the second engagement point is loaded more. By way of the unequal loading of the force engagement points in the different movement directions one achieves an easy rotation and/or translatory displacement of the pane which thus even permits a parallel bearing of the pane onto a defined guide edge.

The force engagement points at the same time may be distanced to one another in any spatial planes. This is due to the fact that a side pane of a modern motor vehicle is often curved once or even twice, thus is not guided along a purely translatory path. The force engagement points may however also be arranged flush and the introduction of the moment into the pane may be realised with a suitable lug design.

With respect to the centre of gravity of the pane it lends itself to distribute the above mentioned force engagement points such that it is simply possible to apply a additional moment onto the pane with which a slight tilting of the pane in the desired direction (thus opposite to the guide edge) and thus an increased contact with the desired guide edge of the guide means is made possible. By way of this the required pane guiding length is substantially influenced. The advantage here is the fact that one side of the pane only needs to be guided to 50%. In contrast so-called cross-arm window-winders with a wind drive one requires an almost 100% guiding of the glass.

One further advantageous further development envisages the pane being driven by a linear element belonging to the drive means. This may be a chain, a pull cable or likewise. The invention is particularly useful with these linear elements which often may only transmit tension loads (and achieve no additional support effect of the pane). Of course the invention may also be applied to linear elements such as racks, etc.

A further advantageous further development envisages the pane being guided in a front or on a rear side door of a motor vehicle. It does not always need to be one door, thus the window-winding arrangement according to the invention may also for example be used for rear side panes of a hatch-back or compact car which are not arranged in a door. Practically all arrangement types are possible here. Additionally the guide edge may be selected accordingly. The longest outer guide rail in which the pane is guided lends itself as a guide edge (thus usually the guide rails arranged in the A and C columns).

A further advantageous further development envisages the motor vehicle door to comprise a modular inner part of plastic and/or metal for carrying parts of the drive means. By way of this it becomes particularly simply possible to premanufacture deflection pieces (for example rollers) or motors belonging to the drive means directly onto these module-like inner parts, and thus the end assembly is again accelerated by way of this.

One construction form to be used often envisages the pane on its lower side to comprise a fixation part belonging to the pane, for moving the pane. It is possible to provide one or two fixation parts. In the case that two fixation parts are provided, for each force engagement point on the window pane one may provide an individual fixation part. This fixation part may be connected in any way with a non-positive and/or positive fit, for example clamped, clipped, glued and/or screwed. In order to obtain a higher stiffness between the fixation part and the window, the PU-bonding method (as a particular adhesive method) of the company Henniges Elastomer-und Kunststofftechnik GmbH & Co. KG/GDX is taken note of. This fixation part serves for binding the pane to the drive means. This fixation part may for example be additionally guided in a pane. In any case it however serves as a force engagement point for example for linear elements of the drive means. Of course one may provide one or more fixation parts. The fixation-part may however also be integrated into the pane itself during its manufacture. In one embodiment form the fixation part may also be simply designed as only a hole in the pane in which a pull cable mechanism may engage.

It is however particularly advantageous for the fixation part or the pane to comprise two fastening points for linear elements, these points being distanced from one another and in each case representing force engagement points for opposite movement directions of the pane. These are preferably arranged below the centre of gravity of the pane in each case on opposite sides in order to achieve a suitable tilting or parallel displacement according to the movement direction with the desired pane section against the guide edge. More exactly stated, a moment acts on the pane and the cable to be pulled up is furthermore aligned such that the vector direction runs through a point resulting from the centre of gravity of the pane and the centre of the friction forces of the pane guiding.

A further advantageous embodiment form envisages the motor vehicle door preferably centrally and below the window opening to comprise at least one pane for guiding the fixation part. This however is purely facultative. One may provide one or more panes. One particularly advantageous further embodiment of this envisages for an edge of the pane described here to be provided as a guide edge of the guide means, against which the fixation part which belongs to the pane and which is preferably unmovable is pressed at a suitable angle.

Advantageous further formations of the present invention are described in the other dependent claims.

Figure 2:
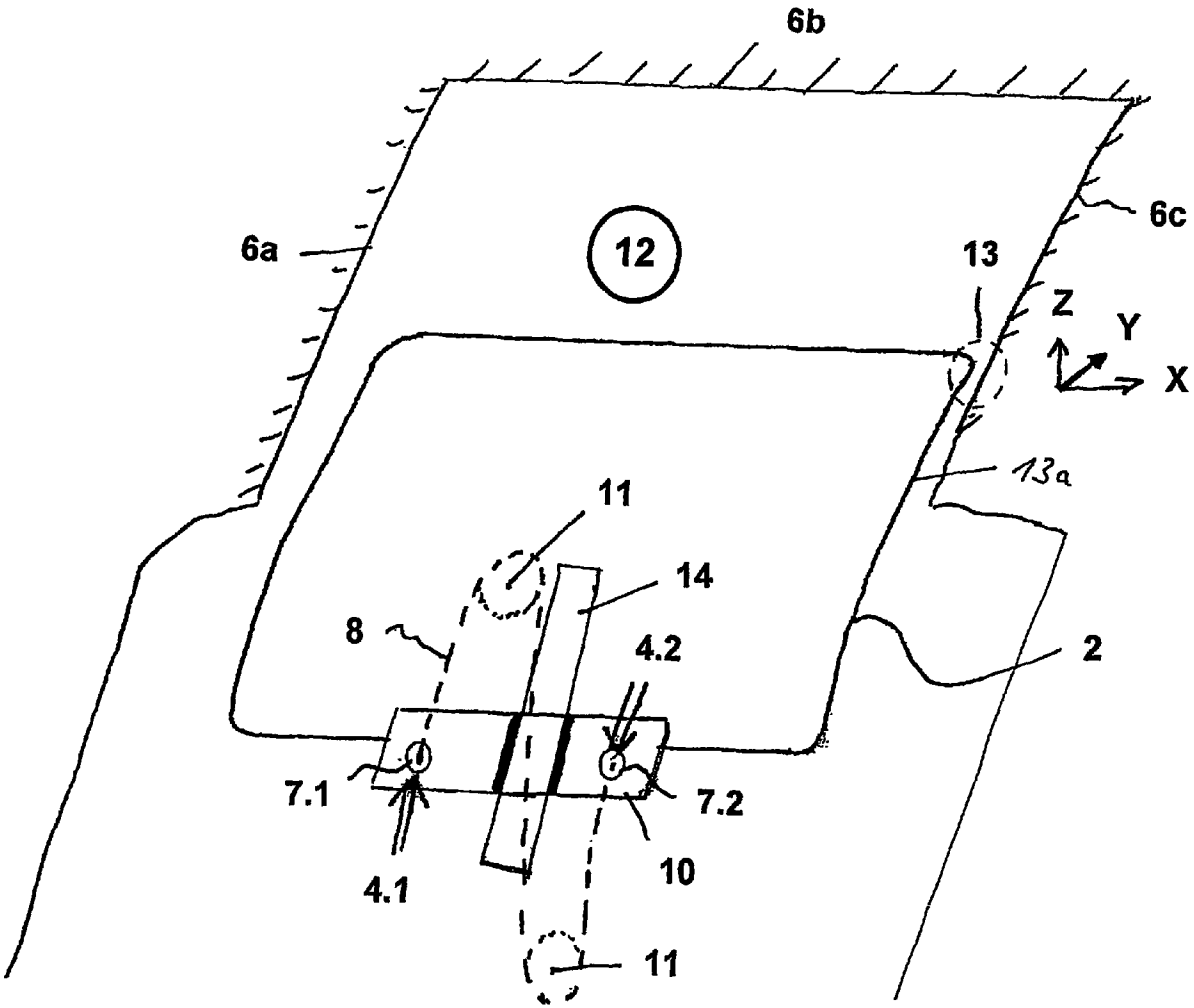
Figure 3:
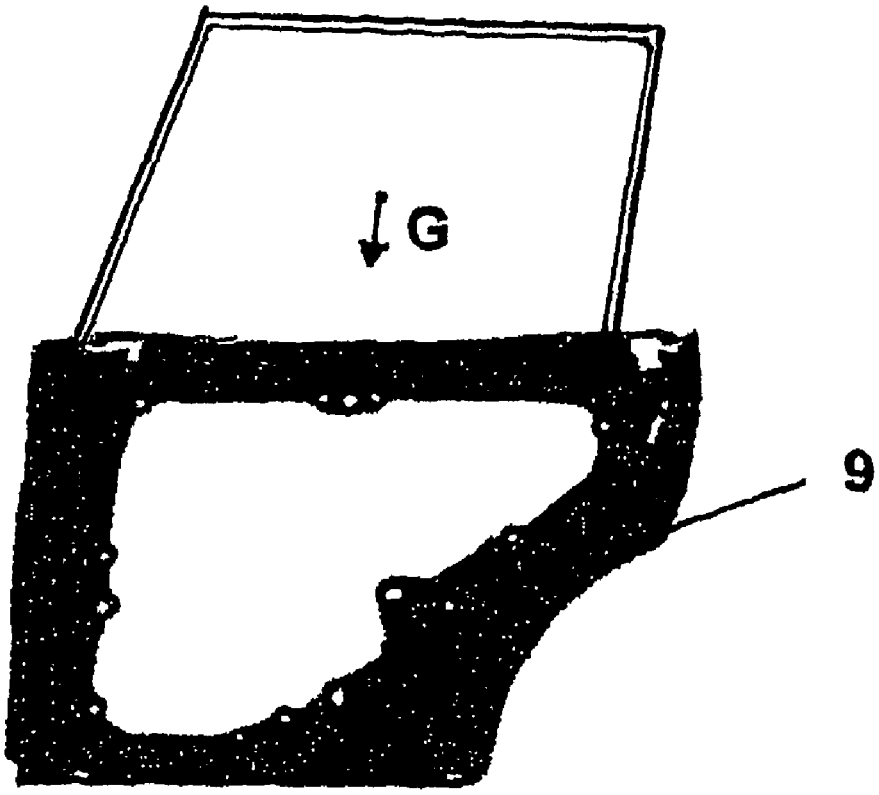
Figure 4:
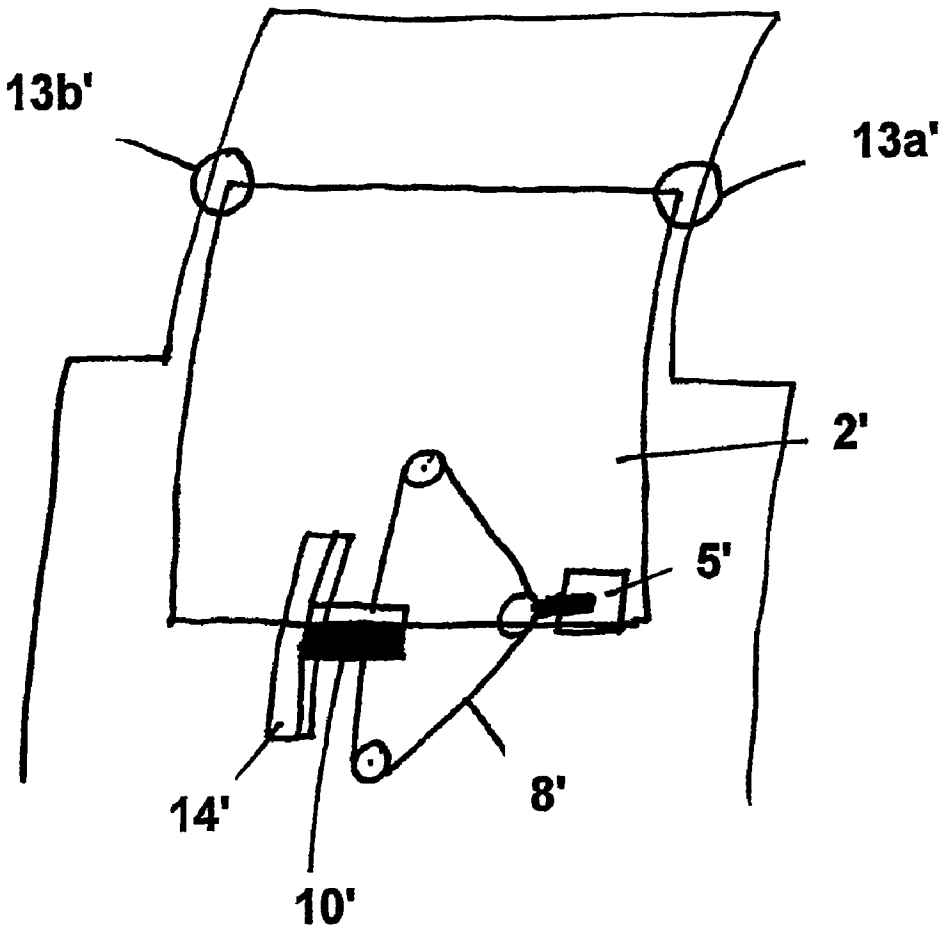
Figure 5:
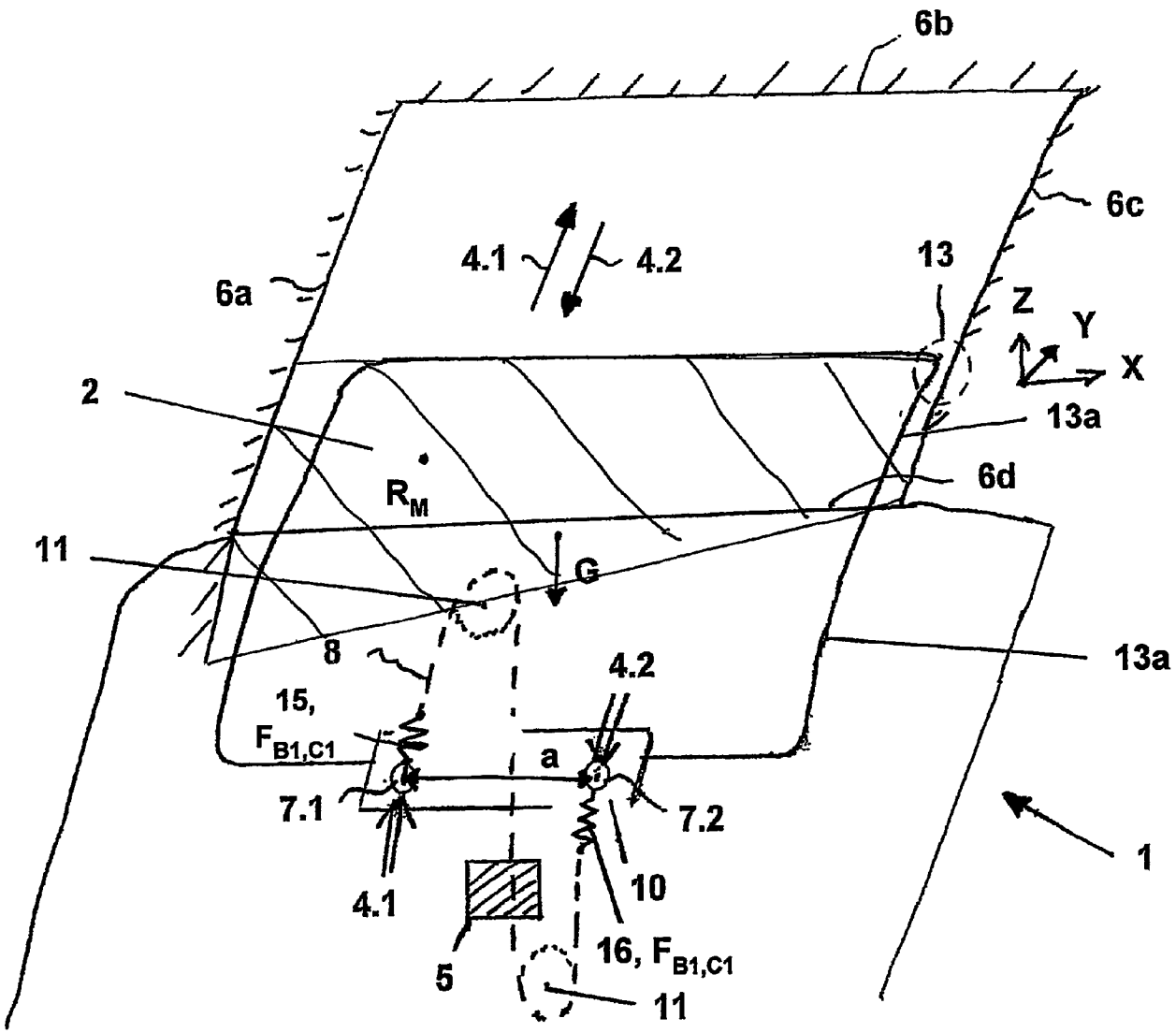

The invention is now explained by way of several Figures. There are shown in:

FIG. 1 a vehicle door with a window-winding arrangement according to the invention, FIG. 2 a modification of the representation shown in FIG. 1, FIG. 3 a view of a not yet competed vehicle door, FIG. 4 a window-winding arrangement according to the state of the art, and FIG. 5 a detailed illustration example of the base of the embodiment form according to FIG. 1

FIG. 1 shows a window-winding arrangement according to the invention. This is arranged in a rear vehicle door of a motor vehicle which is indicated in FIG. 1 by outlines. At the same time the limiting lines 6*a* to 6*d* show the borders of the window opening, the line 6*d* represents a window elbow-place, line 6*a* represents a guide rail for a pane 2, which is arranged on the C column as well as 6*c* a guide rail for the pane 2, which is arranged on the B-column. The guide rails 6*a* or 6*c* as well as a slot arranged in the window elbow place 6*d* in FIG. 1 form the guide means for the pane 2.

The pane 2 (whose centre of gravity is indicated by "G" with an arrow lying next to it) is moved up or down by a drive means when desired by an operator (this movement mainly takes place in the X-Y plane, in particular mainly in the Z-direction). There is however also given a small component in the Y-direction, since with the pane it is also the case of a pane curved in several spatial directions.

The drive means comprises a cable 8 (thus linear element) which is wrapped around deflection pieces 11 designed as rollers. The drive of the cable is effected by an electric motor of the drive means 5 which is operated according to the desires of the occupants (of course a manual operation of the cable is also possible).

The linear element 8 is connected to one or to two fixation part(s) 10 which is clamped onto the lower side of the pane and is additionally screwed so that the fixation part is rigidly connected to the pane or represents an integral component of this. The linear element on the one side is connected to a first force engagement point 7.1 and on the other side at a second engagement point 7.1 to the fixation part 10. The fixation part 10 (due to the rigid connection) is seen as an integral part of the pane 2 within the context of the invention.

The drive and guide means is designed in a manner such that the drive force for moving the pane is applied onto the pane 2 such that this independently of its movement direction is always pressed against a certain guide edge of the guide means. This means that chiefly the pane 2 preferably with its complete right edge, indicated at 13*a* in FIG. 1, is moved such that this bears parallel on the guide edge 6*c* or that the pane 2 with its section 13 (thus the upper corner directed towards the C column which in FIG. 1 is indicated as a dashed circle) is always tilted in the direction of the guide edge 6*c*. This is effected independently of the main movement direction of the pane 2, thus independently of whether this is moved up or down.

This is explained specifically once again. As already described above, the linear element 8 belonging to the drive means 5 is connected on the one side to the first force engagement point 7.1 and on the other side to the second force engagement point 7.2. With the drive of the drive means in a first direction (4.1, this is to be seen by the movement arrows within the window opening, the tension of the linear element 8 and thus its tension force likewise act in this direction as the double arrow on the fixation part 10 shows), the force engagement point 7.1 is primarily loaded since the linear element 8 pulls on the force engagement point 7.1. Thus here the first force engagement point is loaded greater than the second force engagement point 7.2. The first force engagement point 7.1 here is selected with respect to the centre of gravity of the pane 2 (centre of gravity including the fixation part) such that the pane on one side is loaded by the direction of the resulting force in the force engagement point as well as a resulting moment in the X-Y plane with a clockwise moment such that the section 13*a* (or in the unfavourable case only the section 13) is guided in the rail 6*c* or is pressed against this. With a downwards movement in the direction 4.2 then a tension in the opposite direction occurs, that is to say by way of a tension in the direction 4.2 at the second engagement point 7.2 a clockwise moment likewise occurs so that also with this opposite movement the section 13*a* or section 13 is pressed into the rail 6*c*. It is to be noted that the ideal typical force representations described here may be modified in that the gravity force may be large which means that a strong tension 7.2 is not required at the second engagement point in order to move this downwards. At these force engagement points or in the chain for the force engagement points one may provide springs. With a change in the movement direction the correct selection of spring force presetting would avoid a momentary change in the rotational direction. Thus the pane does not detach from the provided guide edge (e.g. the guide edge on the B column). At the same time by way of the design of the complete drive means (for example the arrangement of the rollers 11 of the motor with respect to the centre of gravity of the pane or also the setting of the friction forces in the guide rails 6*a* or 6*c* and of the springs) it is to be ensured that there results as parallel as possible unified bearing of the pane with its section 13*a* on the guide rail 6*c*.

FIG. 2 shows a further embodiment example of the invention. This is essentially identical to the embodiment example according to FIG. 1. The only difference lies in the fact there is additionally provided a rail 14 which is arranged in the door inner space (thus below the window opening 12).

FIG. 3 shows a motor vehicle door 9 according to the invention which is not yet completed. In its lower part this comprises an opening into which an inner part for carrying parts, amongst other things the drive means 5 may be applied. This however is not compellingly necessary, of course other parts of the drive means may also be individually accommodated on the lower part of the motor vehicle door, such as one or two rails for additionally guiding the pane 2.

Concluding, FIG. 4 is referred to which represents the window-winding arrangement according to the state of the art. It may be clearly seen here that the fixation part 10 practically comprises only one force engagement point (or that the upper or lower contact point of the linear element 8' is not laterally displaced to one another) and thus that the pane 2' on movement due to the drive means 5' in each case alternately abuts against the guide rails 13*a*' or 13*b*', this is also not excluded completely by the rail 14'.

FIG. 5 again shows the embodiment forms of the invention according to FIG. 1. FIG. 1 is referred to with regard to all previously described features inasmuch as in not expressly stated otherwise in the following. Furthermore all details specified in the following are also to be applied to this embodiment example according to FIG. 2.

Supplementing, in FIG. 5 the interconnected tension compression springs 15 and 16 are referred to which quasi are connected in series into the linear element 8. In a preferred embodiment, it is also possible that there is only one single spring, for example only spring 15 or only spring 16. Whilst the linear element 8 is designed essentially rigid with regard to stretching, the springs 15 and 16 have a predefined spring stiffness. The spring stiffness C1 of the spring 15 or the spring stiffness C2 of the spring 16 here is preferably in the region of 1.5-3.5 N/mm on loading in the longitudinal direction (i.e. in the direction of the linear element 8), to be selected best however at 2-3 N/mm.

The spring block force ($F_{B1}$ with spring 15 and $F_{B2}$ with spring 16) is preferably between 0 N and 70 N, more preferably between 15 and 70 N most, preferably between 20 and 60 N. These values are in particularly suitable for lighter motor vehicle side windows. According to definition "spring block force" here is to be understood as the force which may be applied as a compression loading in the direction of the linear elements 8 in order to press together the windings of the springs, i.e. a complete bearing of these spring lines. After applying this force a further deformation of the springs is practically not possible, here they react quasi as a rigid body if even higher compression forces are applied.

It is particularly advantageous for the ratio of the spring block forces $F_{B1}$:$F_{B2}$ to be practically equally 1:1.5 to 1:2.5, preferably 1:1.8 to 1:2.2.

In this context the distance of the force engagement points 7.1 as well as 7.2 are to be noted (indicated as "a" in FIG. 5). This distance may lie between 50 and 400 mm, preferably between 70 and 150 mm, particularly preferred between 70 and 100 mm. It is to be stressed once more that all numbers or number ratios specified for FIG. 5 may also be applied to all embodiment forms (see also FIGS. 1 and 2 of the invention), also all subcombination of the respective "interconnected" number combinations may be combined amongst one another, i.e. any distance details for "a" specified in the interval and which specifies the distance between the force engagement points may be combined with any spring details or with any spring block force details inasmuch as they are disclosed here.

Furthermore for explaining in FIG. 5 it is shown that the length of the guide rails to the left and right may of course also be differently large. Likewise for purposes of illustration with a left hatching a so-called "friction surface" is indicated, the centre of gravity of the friction surface is indicated at "$R_M$". According to the invention it is advantageous if the resulting force vector 4.1 which acts on the pane runs between the points $R_M$ and the initial point of the force "G" in FIG. 5.

The invention claimed is:

1. A window-winding arrangement (1), for a side pane (2) of a motor vehicle comprising a drive means (5) for applying a driving force to the pane to cause movement of the pane in two different directions, and a guide means for guiding the pane (2) during movement in either direction, the drive means configured to cause the pane to be pressed against the guide means during movement of the pane in either direction, and wherein the side pane is driven by a linear element associated with the drive means, the linear element having a first spring with a first spring force connected in series to the linear element, and a second spring with a second spring force connected in series to the linear element wherein the ratio between the spring forces is from about 1:1.5 to about 1:2.5, wherein the different spring forces are applied to two distinct locations on the pane to cause an edge of the pane to be biased toward the guide means;

wherein the difference in spring forces causes the pane to be pressed against the guide means during movement of the pane in either direction to limit a momentary change in the rotation direction of the pane when the movement direction of the linear element is changed.

2. The window-winding arrangement according to claim 1, characterized in that a first force engagement point (7.1) and a second force engagement point (7.2) of the drive means (5) are provided, wherein when the drive means is causing movement of the pane in one direction the first force engagement point (7.1) is loaded greater than the second force engagement point and when the drive means is causing movement of the pane in the other direction the second force engagement point (7.2) is loaded greater than the first force engagement point.

3. The window-winding arrangement of claim 1, wherein the guide means comprises a guide edge and the drive means is configured to cause the pane to be pressed against the guide edge during movement of the pane in either direction.

4. The window-winding arrangement of claim 3, wherein the linear element (8) is selected from the group consisting of a chain, a pull cable, a belt, a toothed belt and a rack.

5. The window-winding arrangement of claim 1, wherein the pane (2) is guided in a door of a motor vehicle selected from the group consisting of a front side door, a rear side door (9) and a rear door.

6. The window-winding arrangement of claim 1, wherein the pane (2) comprises a lower side and at least one fixation part (10) on the lower side engaged with the drive means, the fixation part comprised of material selected from the group consisting of metal, plastic and combinations thereof.

7. The window-winding arrangement according to the claim 6, wherein the fixation part (10) is selected from the group consisting of a clip, a clamp, a glue, a screw and combinations thereof.

8. The window-winding arrangement according to claim 7, wherein the fixation part (10) comprises first and second force engagement points (7.1; 7.2) configured to facilitate movement of the pane in either direction (4.1; 4.2).

9. The window-winding arrangement of claim 3, wherein the drive means (5) comprises deflection pieces comprising rollers (11) for deflecting linear elements (8).

10. The window-winding arrangement of claim 5, wherein the motor vehicle door (9) comprises a rail for guiding a fixation part.

11. A motor vehicle door containing a window-winding arrangement according to one of the preceding claims.

12. A motor vehicle comprising a pane and a window-winding arrangement associated with the pane, the window winding arrangement comprising a drive means (5) for applying a driving force to the pane to cause movement of the pane in two different directions, and a guide means for guiding the pane during movement in either direction, the drive means configured to cause the pane to be pressed against the guide means during movement of the pane in either direction, and wherein the pane is driven by a linear element associated with the drive means, the linear element having a first spring with a first spring force connected to the linear element, and a second spring with a second spring force connected in series to the linear element wherein the ratio between the spring forces is from about 1:1.5 to about 1:2.5 wherein the different spring forces are applied to two distinct locations on the pane to cause an edge of the pane to be biased toward the guide means;

wherein the difference in spring forces causes the pane to be pressed against the guide means during movement of the pane in either direction to limit a momentary change in the rotation direction of the pane when the movement direction of the linear element is changed.

13. A window-winding arrangement (1), for a side pane (2) of a motor vehicle comprising:

first and second force engagement points (7.1, 7.2) coupled to the side pane (2);

a first deflection element positioned above the force engagement points when the side pane is in a partially opened position;

a second deflection element positioned below the force engagement points;

a flexible linear element configured to extend upwardly from the first force engagement point (7.1) over the first deflection element, downwardly to and under the second deflection element and upwardly to the second force engagement point (7.2);

a drive means positioned between the first and second deflection elements and configured to engage and move the flexible linear element to apply a driving force to the pane to cause movement of the pane in two different directions;

a linear guide for guiding an edge of the pane (2) during movement of the pane in either direction;

a first spring having a first spring force and connected in series with the flexible linear element between the first force engagement point and the drive means to apply the first spring force to the first force engagement point;

a second spring having a second spring force different form the first spring force, and connected in series with the flexible linear element between the second force engagement point and the drive motor to apply the second spring force to the second force engagement point; and wherein the difference in spring forces causes the edge of the side pane to be pressed against the linear guide during movement of the side pane in either direction to limit a momentary change in the rotation direction of the side pane when the movement direction of the linear element is changed.

* * * * *